United States Patent [19]

Olson et al.

[11] 4,008,875

[45] Feb. 22, 1977

[54] SEQUENCE VALVE FOR CLAMPING APPARATUS

[75] Inventors: John E. Olson, Portland, Oreg.; Richard D. Seaberg, Vancouver, Wash.

[73] Assignee: Cascade Corporation, Portland, Oreg.

[22] Filed: Jan. 2, 1976

[21] Appl. No.: 646,401

[52] U.S. Cl. ..... 251/63.4; 137/106; 214/653

[51] Int. Cl.[2] ..... F15B 13/06

[58] Field of Search ..... 137/106; 251/31, 63.4; 91/392, 447; 214/653

[56] References Cited

UNITED STATES PATENTS 3,678,954 7/1972 Ostwald et al. ..... 137/106

*Primary Examiner*—Alan Cohan
*Assistant Examiner*—Gerald A. Michalsky
*Attorney, Agent, or Firm*—Kolisch, Hartwell, Dickinson & Stuart

[57] ABSTRACT

A fluid control valve which operates accurately in response to the pressure difference that exists between a pair of ports in the valve. The valve features a spool which is normally biased to one control position wherein it remains with the sensed pressure difference being below one preselected amount. The spool shifts rapidly to another control position on the sensed pressure difference exceeding this amount. In this other control position, the spool remains until the sensed pressure difference drops to another preselected amount which is significantly lower than the first-mentioned preselected amount. On this latter event occurring, the spool returns to its first-mentioned control position.

7 Claims, 6 Drawing Figures

SEQUENCE VALVE FOR CLAMPING APPARATUS

BACKGROUND AND SUMMARY OF THE INVENTION

This invention pertains to a fluid control valve, and more specifically to such a valve which is constructed to operate in response to the pressure difference that exists between a pair of fluid-communication ports provided in the valve. A preferred embodiment of the proposed valve is disclosed herein in conjunction with load-clamping apparatus of the type which is mountable on the carriage in a lift truck, in which setting the valve has been found to have particular utility.

There are numerous situations in which it is desired to utilize a fluid control valve whose operating condition at any given point in time is determined by the pressure difference which exists between a pair of spaced apart points in a fluid circuit. For example, it has been found to be desirable to employ such a valve in the setting of load-clamping apparatus of the type which is mountable as an attachment on the carriage in a conventional industrial lift truck. In this setting, the desirability of using such a valve stems from the desire to maximize both the speed and efficiency of such apparatus by supplying and exhausting fluid to its clamping cylinders (typically two such cylinders) in response to the actual loaded and unloaded conditions of the clamping arms in the apparatus. It will be apparent that such loaded and unloaded conditions may be determined from the difference in pressure which exists in fluid in the two main conduits used for supplying fluid to and exhausting it from such cylinders.

A further consideration, and one that applies to the setting of load-clamping apparatus, is that it is often desirable to have a control valve of the type generally indicated shift from one control condition to another control condition when one preselected pressure difference exists, and to have the reverse action take place when another, and perhaps significantly lower, preselected pressure difference exists.

A general object of the present invention is to provide a unique differential fluid control valve which takes these considerations into account in a practical and satisfactory manner.

More specifically, an object of the invention is to provide a fluid control valve which is capable of performing accurately and quickly all of the functions discussed above.

Thus, an object of the invention is to provide a control valve of the type generally outlined which will accurately respond to a preselected pressure difference between a pair of ports in the valve to shift a spool therein from one control condition to another.

Another object of the invention is to provide such a valve in which an adjustment may be made so as to change the specific amount of pressure difference which is required to cause such shifting of the spool.

A further object of the invention is to provide a valve of the type indicated wherein the spool, once shifted as just indicated, returns to its initial control condition only when the sensed pressure difference drops below another preselected pressure difference which is significantly lower than that which was required to cause initial shifting of the spool.

According to a preferred embodiment of the invention, the proposed valve includes a body in which there is mounted a spool that is shiftable between a pair of control positions. This spool includes first and second working surface areas, on its opposite sides, on which pressure fluid may act to shift it toward these control positions. A spring acting on the spool urges it normally toward one of such positions.

The pressure difference of interest which is to be utilized for shifting the spool is sensed at a pair of ports in the body, and fluid passages are provided in the body for communicating betweens these ports and the opposite sides of the spool.

A unique feature of the valve is that a part is provided therein which is interposed between the first working surface area on the spool and the passage which communicates with this working surface area — this part being constructed to enable exposure (to pressure fluid within such passage) of only a portion of the first working surface area with the spool in its control position to which it is biased by the spring. This part is further constructed to enable exposure of the full extent of the first working surface area to such pressure fluid with the spool shifted toward its other control position. This construction promotes operation whereby the spool must be exposed initially to a relatively large sensed pressure difference before it shifts from that control position to which it is normally biased. However, once it has shifted, and because there is now a larger portion of the first working surface area which is exposed to that pressure fluid which initially shifted the spool, a significantly lower pressure difference is required to hold the spool in its shifted position.

Another unique feature of the proposed valve is the incorporation of what is referred to as changeable-condition pressure-balancing means for the spool which, with the spool in its normal or nonshifted position, exposes both the second working surface area, and that portion of its first working surface area which is not exposed by the part just mentioned, to the same pressure fluid. This construction minimizes spool resistance to movement from its normal position. Such an arrangement also maximizes the accuracy with which the spool responds to that preselected pressure difference which is intended to cause the spool to shift away from its normal position. The pressure-balancing means further performs whereby, once the spool begins to shift away from its normal position toward its other control position, it blocks communication between the opposite sides of the spool so as to allow the full sensed pressure difference to act on the spool.

These and other objects and advantages which are attained by the invention will become more fully apparent as the description which now follows is read in conjunction with the accompanying drawings.

DETAILED DESCRIPTION OF THE INVENTION

Figure 1:
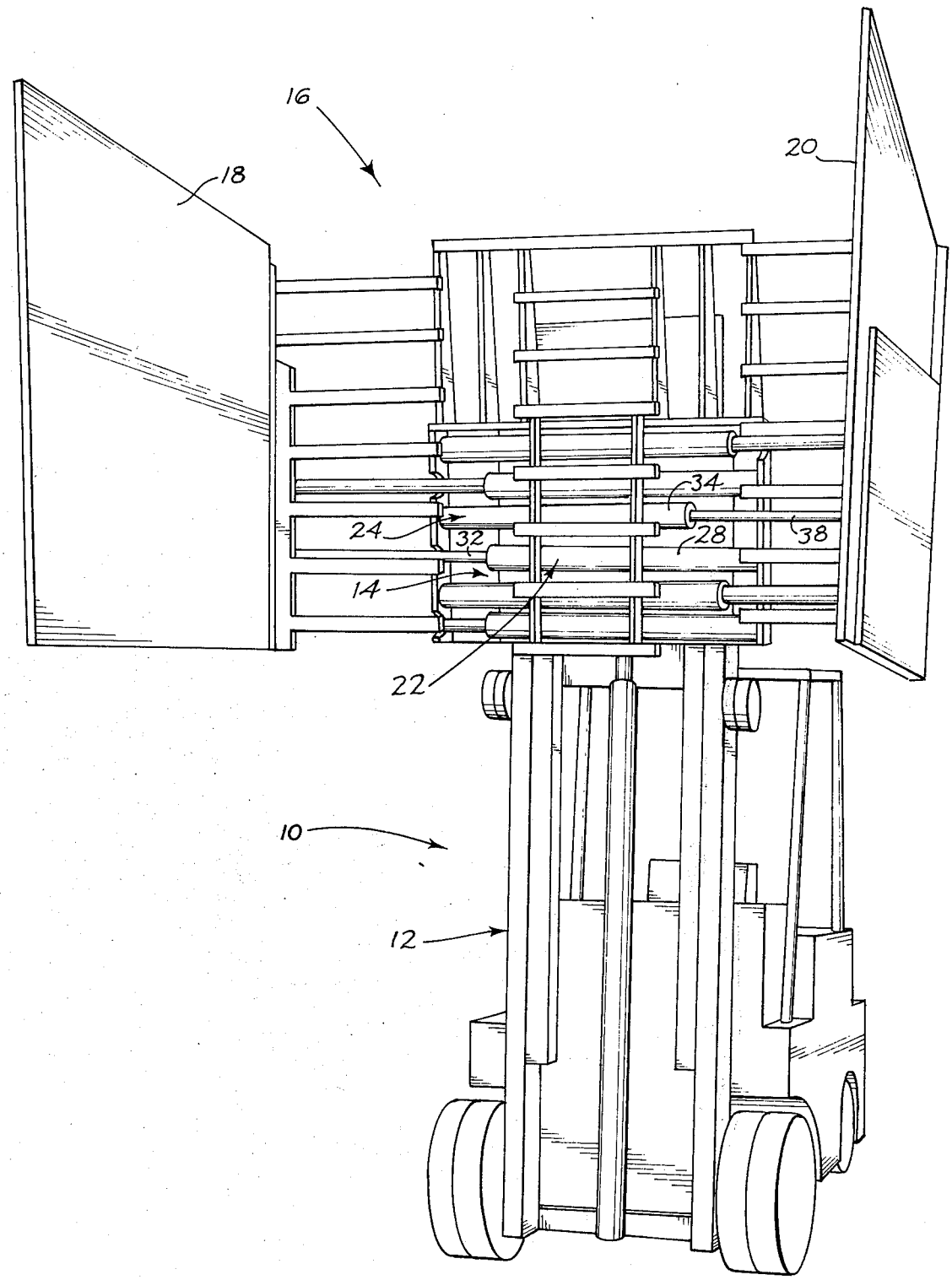
FIG. 1 is a simplified front perspective view of a lift truck employing clamping apparatus utilizing a control valve constructed in accordance with the present invention.

Turning now to the drawings, and referring first to FIG. 1, indicated generally at 10 is a conventional lift truck, including the usual vertically extensible contractible mast 12, and vertically raisable and lowerable carriage 14. Mounted on this carriage is a load-clamping mechanism 16, including a pair of opposed relatively movable clamping arms 18, 20 which are moved by double-acting hydraulic motors 22, 24, respectively.

Figure 2:
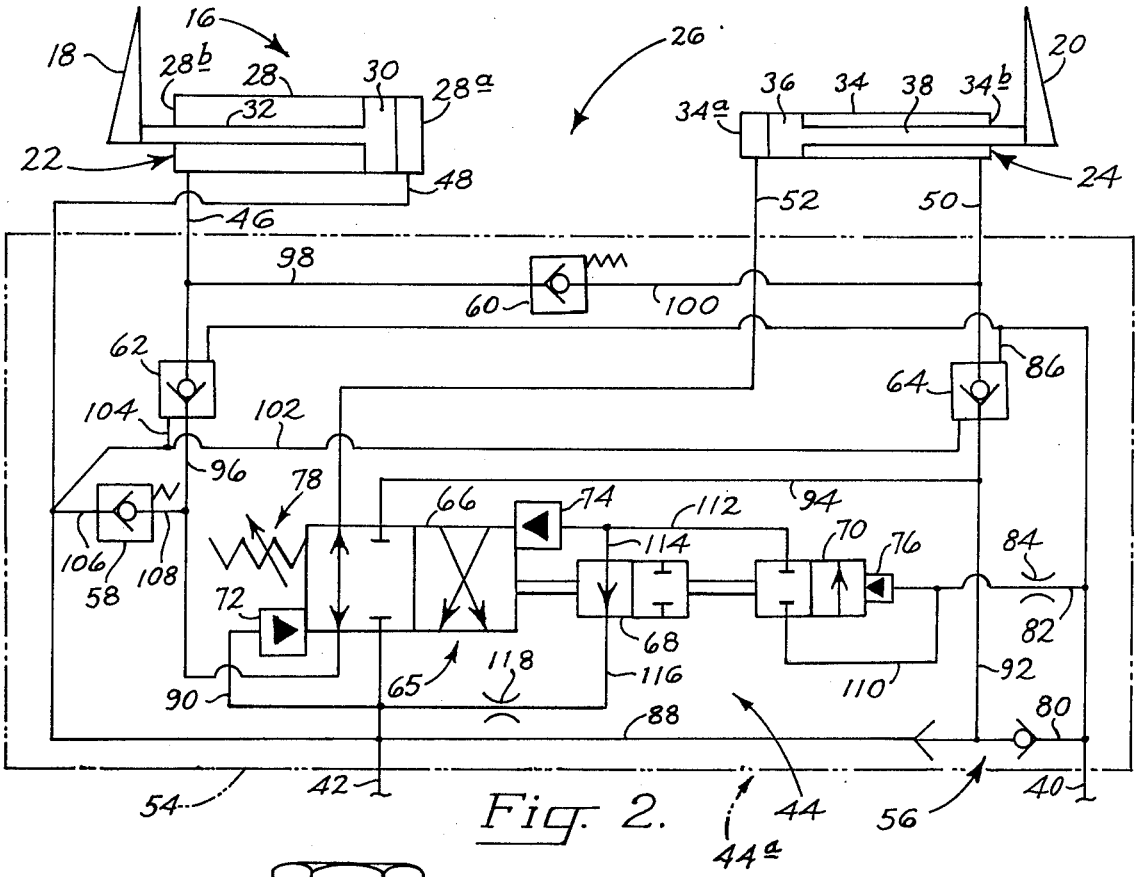
FIG. 2 is a schematic diagram illustrating the proposed valve in the setting of the clamping apparatus used in the truck of FIG. 1.

Hydraulic circuitry, including a control valve constructed in accordance with the present invention, for operating motors 22, 24 is shown generally at 26 in FIG. 2. Thus, and referring now particularly to FIG. 2, previously mentioned arms 18, 20 and motors 22, 24 are shown in this figure in extremely simplified form. Motor 22 includes the usual cylinder 28 in which is mounted a piston 30 that is connected to a projecting rod 32. The butt and rod ends of cylinder 28 are shown at 28*a*, 28*b*, respectively. Similarly, motor 24 includes a cylinder, piston and rod 34, 36, 38, respectively. The butt and rod ends of cylinder 34 are shown at 34*a*, 34*b*, respectively. Clamping arms 18, 20 are suitably attached to the outer ends of rods 32, 38, respectively, whereby reciprocal movement of the pistons in the cylinders effects movement of the arms.

In the clamping apparatus illustrated, motors 22, 24 are of different sizes, with the former being larger than the latter. The relative sizes of these two motors have been chosen whereby the working surface area for pressure fluid on the butt end side of piston 36 is substantially the same as that on the rod end side of piston 30.

Indicated at 40, 42, are two conduits which connect with a conventional supply of pressure fluid that is provided on truck 10. Conduits 41, 42 supply and exhaust pressure fluid with respect to motors 22, 24 through a control valve 44, which forms part of a multiple valve unit 44*a*, and which is constructed in accordance with the present invention. As will become apparent shortly, valve 44 is operable to effect different kinds of fluid interconnections between the motors and conduits 40, 42 for directing fluid flow to and from the motors so as to maximize the speed and efficiency with which these motors may be used. Valve 44 connects with the rod and butt ends of cylinder 28 through conduits 46, 48, respectively, and to the rod and butt ends of cylinder 34 through conduits 50, 52, respectively.

It has been found convenient herein to mount the various parts of control valve 44 in a unitary package with certain other valve units, or valves, especially adapted for use in the operation of motors 22, 24. This package, which constitutes what is referred to herein also as a valve body, is indicated in FIG. 2 by dash-double-dot line 54. The other valves just mentioned include a shuttle valve 56, a pair of spring-biased check relief valves 58, 60, and a pair of vented, pilot-operated check valves 62, 64.

For explanatory purposes only, valve 44 is shown simply schematically in FIG. 2 and is represented in this figure as including three joined-together spool portions 66, 68, 70. In actuality, and as will become apparent shortly, these three spool portions form part of a single spool 65 in valve 44. Each of these three spool portions is represented as a rectangle divided into two squares, with the flow that is permitted through the portion depicted by the markings contained within the squares. These spool portions are shown in FIG. 2 in what may be thought of as their normal positions.

Associated with the left and right ends of portion 66 in FIG. 2 are what are referred to herein as actuators 72, 74, respectively. Associated with the right end of spool portion 70 in FIG. 2 is an actuator 76. As will also become apparent shortly, actuators 72, 74, 76 in fact take the form of working surface areas for pressure fluid — which areas are formed on the spool in valve 44. It may be noted that the effective working surface area for pressure fluid defined by actuator 74 is considerably larger than that defined by actuator 76. For this reason, actuator 74 is shown as being somewhat larger in FIG. 2 than actuator 76.

An adjustable spring-biasing mechanism, or means, shown generally at 78 acts on the left end of spool portion 66 in FIG. 2, urging this portion, as well as portions 68 and 70, to the right in the figure. This position for the spool portions is referred to herein as one of the control positions for valve 44.

Continuing now with an overview of what is shown in FIG. 2, previously mentioned conduit 40 connects through a conduit 80 with the right input side of shuttle valve 56 in FIG. 2, through a conduit 82 and a flow restrictor 84 with the working surface side of actuator 76, through a conduit 86 with the vent side of valve 64, and directly with the vent side of valve 62. Conduit 42 connects through a conduit 88 with the left input side of the shuttle valve in the figure, directly with previously mentioned conduit 48, through a conduit 90 with the working surface side of actuator 72, and directly with the bottom side of spool portion 66 in FIG. 2.

A conduit 92 interconnects the output of the shuttle valve with the seat side of valve 64, this conduit also connecting through a conduit 94 with the upper side of spool portion 66 in FIG. 2. The ball side of valve 64 connects directly with conduit 50.

Previously mentioned conduit 46 connects with the ball side of valve 62 — the set side of this valve being connected through a conduit 96 with the bottom side of spool portion 66 in FIG. 2. Previously mentioned conduit 52 connects directly with the top side of spool 66 in FIG. 2.

Conduits 98, 100 connect the seat and ball sides, respectively, of valve 60 with conduits 46, 50, respectively. Piloting for valves 62, 64 is provided by conduits 102, 104, with conduit 102 connecting the pilot side of valve 64 directly with conduit 48, and connecting conduit 48 with the pilot side of valve 62 through conduit 104. The seat and ball sides of valve 58 connect through conduits 106, 108, respectively, with conduits 48, 96, respectively.

Completing a description of what is shown in FIG. 2, a conduit 110 connects conduit 82 with the lower side of spool portion 70 — the upper side of this spool portion being connected through a conduit 112 with the working surface side of actuator 74, and through conduit 112 and a conduit 114 with the upper side of spool portion 68 in FIG. 2. A conduit 116 connects the lower side of spool portion 68 in FIG. 2 through a flow restrictor 118 with previously mentioned conduit 42.

Figure 3:
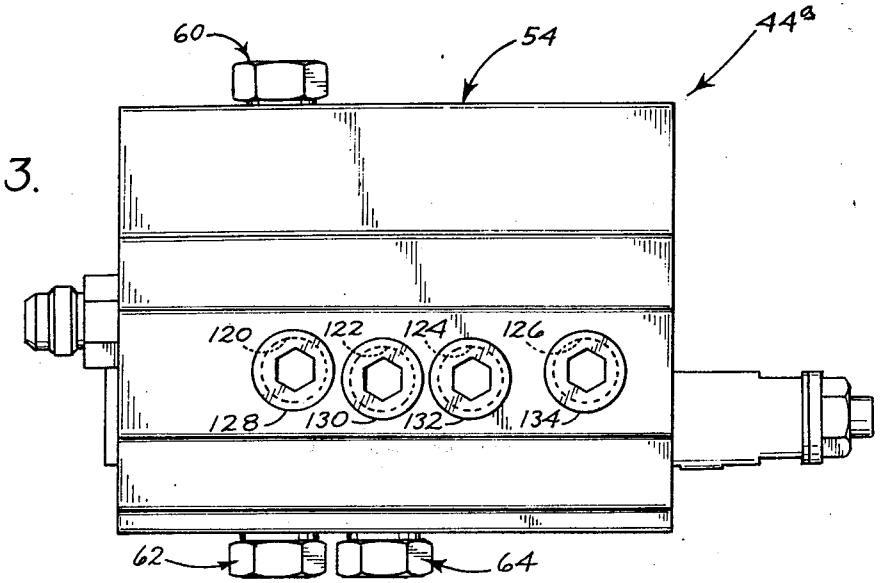
Figure 5:
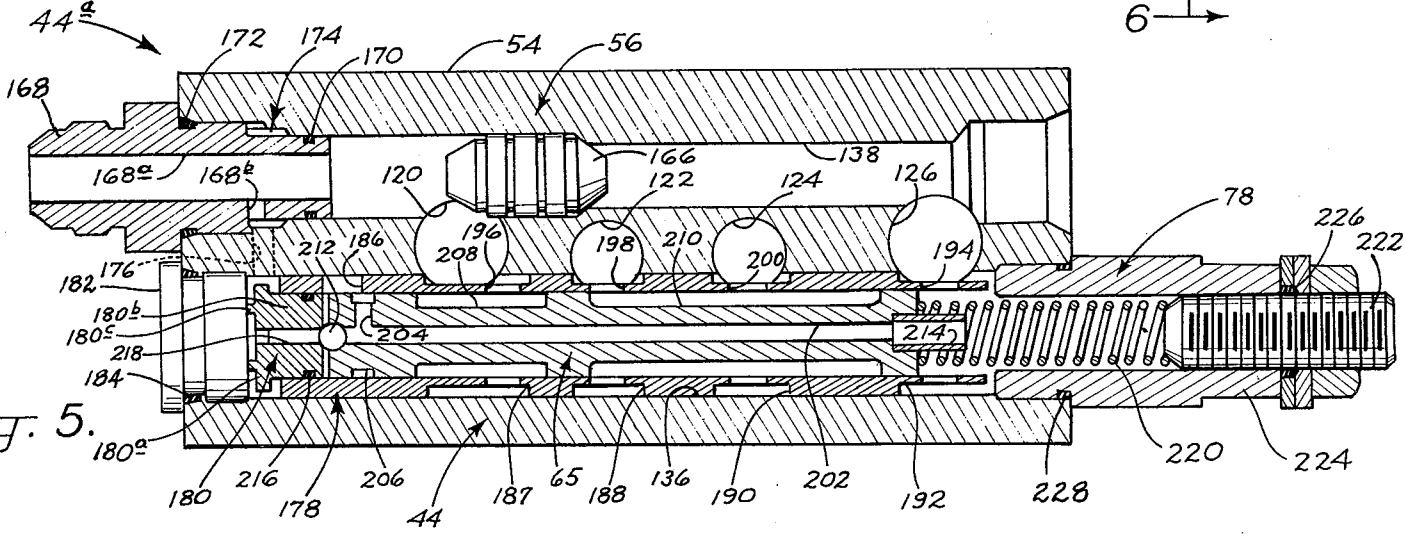

FIGS. 3–6, inclusive, illustrate details of construction of valve 44 and of the other valves shown in FIG. 2. FIG. 3 shows generally a front side elevation of the valve, and FIG. 4 an end elevation taken from the right side of FIG. 3. These two figures indicate the configuration proposed herein for valve body 54. Extending into body 54 from the front face thereof are bores 120, 122,

124, 126, the inner ends of which bottom out within body 54, and the outer ends of which are closed off by plug 128, 130, 132, 134, respectively. These bores extend in a generally horizontal plane as the valve is depicted in FIGS. 3–6. Considering FIG. 5, these four bores intersect and communicate with a cross bore 136 which extends completely through body 54 from the left to the right side thereof as shown in FIG. 5. In addition, it will be seen that bores 120, 126 communicate with a stepped-diameter cross bore 138 which likewise extends completely through body 54.

Figure 6:
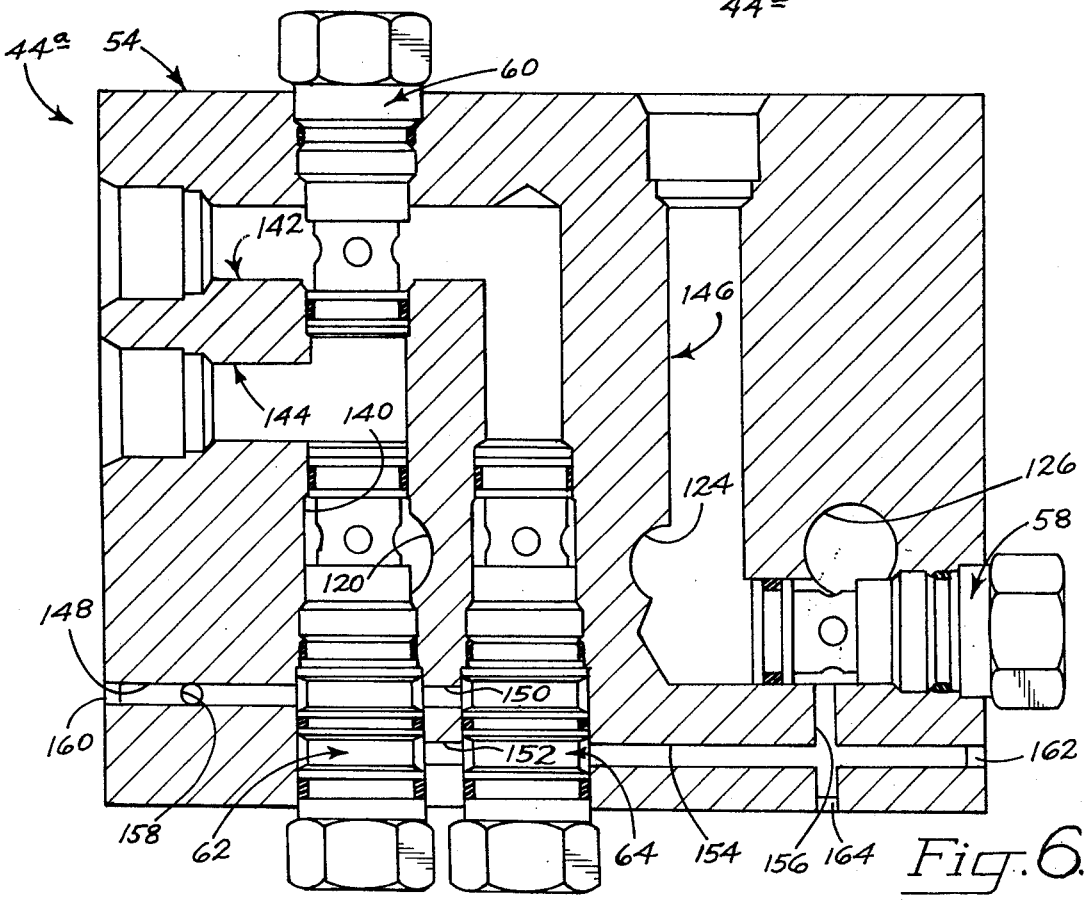
FIGS. 5 and 6, which are on a larger scale than FIGS. 3 and 4, are cross-sectional views taken generally along the lines 5—5 and 6—6, respectively, in FIG. 4.
Figure 4:
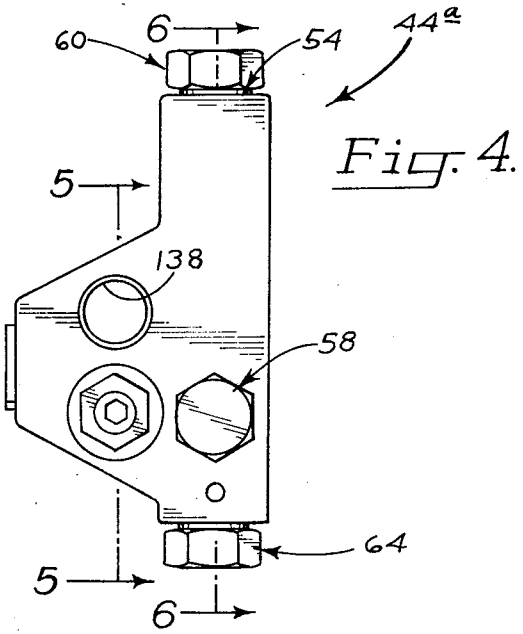
FIGS. 3 and 4 are front side and end views, respectively, of an embodiment of the proposed valve.

Referring to FIG. 6, bore 120 communicates with a vertically extending bore 140 which completely extends through body 54. An upper portion of bore 140 intersects at a right angle with the horizontal portion of a bore 142, the left end of which opens to the left side of body 54 in FIG. 6. Bore 142 also includes a downwardly extending portion which opens to the bottom side of the valve body in FIG. 6. Slightly below its intersection with bore 142, bore 140 intersects a horizontal bore 144 which opens to the left side of body 54 in FIG. 6. The downwardly extending portion of bore 142 communicates with previously mentioned bore 122.

Still referring to FIG. 6, further formed within body 54 is a bore 146 having a vertically extending portion which opens to the top of the valve body in the figure, and a horizontal portion which extends to the right side of the body in the figure. Where these two portions join, bore 146 communicates with previously mentioned bore 124. The horizontally extending portion of bore 146 communicates with previously mentioned bore 126.

Further provided within the valve body are horizontally eztending bores 148, 150, 152, 154 and a vertically extending bore 156. Bore 148 extends in from the left side of the valve body in FIG. 6 and communicates with bore 140. In addition, bore 148 communicates with another horizontal bore 158, the latter being disposed at a right angle to the former, and extending forwardly in the valve body to communicate with the left end of previously mentioned bore 136. Bores 150, 152 interconnect the vertically extending portion of bore 142 with bore 140. Bore 154 extends from the vertically extending portion of bore 142 to the right side of body 54 in FIG. 6. Bore 156 extends from the horizontally extending portion of bore 146 to the base of the valve body in FIG. 6. Plugs 160, 162, 164 close the outer ends of bores 148, 154, 156, respectively.

With reference still particularly to FIG. 6, previously mentioned valves 58, 60, 62, 64 are shown in these figures. These valves are commercially available units which are completely conventional in construction. As can be seen, valve 58, which is a check relief valve, is fitted within the horizontally extending portion of bore 146. The valve is oriented so as to permit fluid flow from bore 126 to bore 146, and to check flow in the opposite direction. Valve 60, which is also a check relief valve, is fitted as shown within bore 140. This valve is oriented to permit fluid flow from bore 142 to bore 140, and to block such flow in the reverse direction. Valves 62, 64, which are vented, pilot-operated check valves, are fitted as shown within the bottom ends of bores 140, 142, respectively. Valve 62 is oriented to permit flow from bore 120 upwardly into bore 140, and to prevent flow in the reverse direction. Valve 64 is oriented similarly to permit flow upwardly into bore 142 from bore 122, and to block flow in the reverse direction.

Piloting for valves 62, 64 is accomplished through pressure fluid available in bores 156, 154, 152. Venting for these two valves is provided by bores 150, 148, 158.

Suitably fitted (although not shown) within the left end of bore 142 in FIG. 6 is a fitting which connects with previously mentioned conduit 46. Similarly, fitted (although not shown) within the left end of bore 144 in FIG. 6 is a fitting which connects with conduit 50. Further, fitted (though not shown) within the upper end of bore 146 in FIG. 6 is a fitting through which a connection is established with conduit 52.

Shuttle valve 56 is seen in FIG. 5. This valve includes a shuttle 166 which is fitted as shown within the large-diameter portion of bore 138. Disposed within the left end of bore 138 in FIG. 5 is a fitting 168 through the central bore 168*a* in which communication is established between bore 138 and previously mentioned conduit 40. Fitting 168 is sealed at axially spaced points to bore 138 by inner and outer seal assemblies 170, 172, respectively. Between seal assemblies 170, 172 there is a clearance space 174 within bore 138, which space communicates, through a radially extending bore 168*b* in fitting 168, with bore 168*a*. This space also communicates with the left end of bore 136 through a vertically extending bore 176.

Shuttle 166 is prevented against axial movement to the right in FIG. 5 through engagement with the shoulder which is formed where the large and small-diameter portions of bore 138 join. With the shuttle in this position, fluid communication is permitted between bore 120 and the left end portion of bore 138. When the shuttle shifts to the left in FIG. 5, leftward movement is prevented by engagement of the shuttle and the inner end of fitting 168. With the shuttle in this position, communication is afforded between bore 120 and the right end portion of bore 138.

Suitably mounted within the right end of bore 138 in FIG. 5 (although not shown in this figure) is a fitting which connects with previously mentioned conduit 42.

Still referring especially to FIG. 5, control valve 44 is shown therein generally. It will be seen that the parts of this valve are mounted within bore 136. Included generally within valve 44 are on elongated tubular sleeve 178, within which is slidably mounted previously mentioned spool 65. Also, slidably received within the left end of sleeve 178 in FIG. 5 is a piston 180. The left end of bore 136 in FIG. 5 is closed off by a plug 182 which is sealed to the bore through a seal assembly 184.

Sleeve 178 is press-fitted to the position shown within bore 136. Progressing axially along the sleeve from its left end in FIG. 5, it includes a radially extending bore 186, also referred to herein as a cut-away portion, three annular channels 187, 188, 190 formed on the outside of the sleeve and communicating with previously mentioned bores 120, 122, 124, and at its right end, a reduced-diameter portion 192 having radially extending bores, such as that shown at 194. Channels 187, 188, 190 are provided each with a plurality of radially extending bores such as those shown at 196, 198, 200, respectively. These bores permit fluid communication between the inside and outside of the sleeve.

Spool 65 is an elongated cylindrical element having a central axial stepped-diameter bore 202 which extends completely through the spool, which joins with a radially extending bore 204 located adjacent the left end of the spool in FIG. 5. Bore 204 communicates with an annular channel 205 formed on the outside of the spool. Progressing axially along the spool from its left end in FIG. 5, two other annular channels are formed on the outside of the spool, these being shown at 208, 210. Pressed into the left end of bore 202 in FIG. 5 is a ball 212 which projects as shown, from the left end of the spool. Fitted in the right end of bore 202 in FIG. 5 is a tubular part 214, the function of which will be explained shortly.

Piston 180 includes a large diameter portion 180*a* which joins integrally with a small-diameter portion 180*b* that is slidably received within sleeve 178. A seal assembly 216 seals the outside of portion 180*b* and the inside of sleeve 178. Formed on the left end of piston 180 in FIG. 5 is an annular rim 180*c*. It will be noted that the outside diameter of this thin-walled rim is less than the outside diameter of piston portion 180*b*. Piston 180 is shown in FIG. 5 as being disposed with rim 180*c* "bottomed-out" against plug 182. Provided within piston 180 is an axially central through-bore 218 which extends completely through the piston.

Previously mentioned biasing mechanism 78 is shown generally in FIG. 5. This mechanism includes a compressed biasing spring 220 which acts between the right end of spool 65 in FIG. 5 and a screw-adjustable plug 222 which is screwed into a fitting 224 that is received within the right end of bore 136 in FIG. 5. A seal assembly 226 provides a seal between fitting 224 and plug 222. A seal assembly 228 seals fitting 224 to bore 136. Tubular part 214 functions to maintain the action of spring 220 centered on the right end of spool 65. Under the influence of spring 220, the spool is urged normally to the left in FIG. 5 to the position shown for it where the projecting portion of ball 212 seats against the rim of the right end of bore 218 in piston 180.

Let us consider now for a moment just the operation of control valve 44. In essence, the control valve is arranged herein to be responsive to the pressure difference which exists between the left and right ends of bore 138, and hence between conduits 40, 42. Communication between conduit 40 and the valve is provided through bores 168*a*, 168*b*, space 174, bore 176 and the left end of bore 136. Communication between conduit 42 and the valve is provided through bores 138, 126, 194, and the right end of bore 136. As has previously been mentioned, it is intended that valve 44, through sensing this pressure difference, control the interconnections which exist between a source of pressure fluid and motors 22, 24. These interconnections are effected herein through the relative positioning of channels 208, 210 with respect to bores 196, 198, 200, 194. The exact control functions which are effected by the valve are not considered to be a part of the present invention. What is considered to be important is the way in which the valve responds to the sensed pressure difference mentioned to shift between the two "control conditions" in which it is capable of functioning.

With the various parts in the valve in the relative positions shown for them in FIG. 5, spool 65 is said to be in one of its two possible control positions. Ball 212 sealingly engages the right end of bore 218 in piston 180, and blocks fluid flow through this bore. The ball also results in there being a gap between the face of the right end of piston 180 in FIG. 5 and the face of the left end of spool 65 in the figure. Channel 206 communicates with bore 186.

The overall effective working surface area on the left end of spool 65 in FIG. 5 is the surface area of a circle having the diameter of the spool. It will be noted that with the spool in the position shown for it in FIG. 5, a relatively small portion of this working surface area is exposed to bore 218, whereas a considerably larger remaining portion of this surface area is exposed in the gap between the piston and valve spool. Referring back for a moment to the functional schematic diagram of the valve shown in FIG. 2, that small portion of this working surface area which is exposed initially to the inside of bore 218 is what is referred to earlier as the working surface area defined by actuator 76. Similarly, that larger portion of the working surface area on the left end of the spool which is exposed in the gap between the piston and the spool is what was referred to earlier as the working surface area defined by actuator 74.

The effective working surface area provided at the right side of the spool in FIG. 5 is the area of a circle also having the same diameter as that of the spool. And, it will be noted that with the parts in the valve in the positions shown in FIG. 5, pressure which acts on the right side of spool 65 is also permitted to act on that portion of the left side the spool which is exposed within the gap between piston 180 and the spool. Communication allowing this situation is provided through bores 202, 204, channel 206 and bore 186. These elements are referred to herein collectively as changeable-condition pressure-balancing means. It will thus be apparent that the pressure of fluid in conduit 42 is initially substantially balanced with respect to the effect which it has on the spool.

Depending on the specific pressure which exists in conduit 42, and upon the compression in spring 220, a certain relatively high pressure must exist in conduit 40 before the spool will shift away from the position shown for it in FIG. 5. It is desirable that the spool shift only when this high pressure has been properly reached. Experience has shown that in many hydraulic circuits when pressure fluid is initially supplied, there is a pressure peak or spike, and it is desired that this spike not be interpreted as a condition where an appropriate pressure difference has been reached between conduits, such as conduits 40, 42. Slidable piston 180 is provided herein for taking the shock of such a spike, and what will in fact happen in the valve with such a spike is that the piston will jump momentarily to the right in FIG. 5, pushing spool 65 along with it. Previously mentioned annular rim 180*c* provides a working surface area outwardly of the rim on the left side of piston 180 in FIG. 5 which allows pressure fluid to act to produce this action. In other words, it is desirable that no relative movement occur between piston 180 and spool 65 until the desired pressure difference exists between conduits 40, 42.

As was mentioned earlier, a relatively large pressure difference is required to cause shifting of the spool. This is because the pressure of fluid in conduit 40 initially is enabled to act only on the relatively small surface area of ball 212 which is exposed in bore 218. Hence, it requires a relatively large fluid pressure to produce sufficient force to shift the spool. When this pressure is reached, however, the spool shifts, whereupon ball 212 moves away from sealing engagement with piston 180. When this occurs, then the full effective working surface area on the left side of spool 65 is exposed to pressure, and the spool rapidly shifts to the right in FIG. 5 to a position bottoming out against fitting 224. With such shifting of the spool it will be seen that channel 206 shifts away from a position communicating with bore 186, and as a consequence the pressure of fluid on the right side of the spool is no longer able to act in a balancing fashion on any portion of the left side of the spool. It will further be noted that once the full effective working surface area on the left side of the spool is exposed, a relatively low pressure difference between conduits 40, 42 will be all that is required to maintain the spool in its shifted position.

Plug 222 may be adjusted to set the compression level within spring 220 which will produce initial shifting of spool 65 at the desired pressure difference between conduits such as conduits 40, 42.

Considering FIG. 2 along with FIG. 5, what is shown in FIG. 2 as spool portion 66 is that portion of spool 65 which includes channels 208, 210 and bores 194, 196, 198, 200. What is shown as spool portion 68 is formed by bores 202, 204, channel 206 and bore 186. What is shown as spool portion 70 is represented by ball 212 and piston 180. Bore **168*b* functions as flow restrictor 84. Bore 204 functions as flow resistor 118.**

Let us consider now in a schematic sense, how valve 44 operates with the other apparatus shown in FIG. 2 and let us assume that clamping arms 18, 20 are initially disengaged from any external body, and it is desired to move them toward one another to clamp onto a load. To accomplish this, the usual main control valve (not shown) included on the lift truck is adjusted to supply pressure fluid through conduit 40, and to exhaust fluid through conduit 42. As a consequence, the shuttle within shuttle valve 56 shifts to the left in FIG. 2 admitting pressure fluid to conduit 92. Such fluid then flows through valve 64 and conduit 50 to the rod end of cylinder 34. Fluid flow through conduit 94 and spool 66 is, at this time, blocked. As a consequence, the piston in motor 24 begins moving to the left in FIG. 2, with pressure fluid then exhausting from the butt end of cylinder 34. As can be seen, this exhausting fluid flows directly into the rod end of cylinder 28 through conduit 52, spool 66, conduit 96, valve 62, and conduit 46. Thus, the piston in motor 22 begins moving to the right in FIG. 2.

Because of the fact that the working surface area on the butt end side of piston 36 is essentially the same as that on the rod end side of piston 30, simultaneous equal movements, in opposite directions, are produced in arms 18, 20. More specifically, for each given unit distance that arm 20 moves to the left in FIG. 2, arm 18 moves an equal distance to the right in the figure. Fluid contained in the butt end of cylinder 28 exhausts through conduit 48 to conduit 42. It will be noted that, considering all of the available working surface areas on the two pistons in the motors, closure of the arms upon one another to clamp against a load results from the directing of pressure fluid to the very smallest of these working surface areas. This working surface area is, namely, that on the rod end side of piston 36. Also, it will be noted that the motors are, under such circumstances, connected essentially in series with one another, with pressure fluid being supplied from the main supply on the lift truck only to one side of one of the motors. Thus, it will be apparent that only a minimum amount of pumped pressure fluid is required to produce a given amount of clamping arm travel during closing of the arms. Also, since the motors are connected essentially in series, a given amount of pressure fluid flow produces a maximum amount of arm travel speed. Accordingly, unimpeded closing of the clamping arms can be accomplished with relatively high efficiency respecting both the amount of pumped pressure fluid which is required, and also respecting the amount of time required for the arms to close a given distance.

Until movement of one of the two clamping arms toward the other becomes impeded by contact with the side of a load, the situation just described remains unchanged. All during this time, it should be noted, that valve 44 is, in essence, sensing the pressure difference between conduits 40, 42. Sensing of the pressure within conduit 40 is accomplished through conduit 82 and actuator 76. Sensing of the pressure within conduit 42 is accomplished through conduit 90 and actuator 72.

When travel of one of the arms becomes impeded, the situation changes. More specifically, the pressure within conduit 40 builds very rapidly while that within conduit 42 drops, and when the pressure difference between fluid in these two conduits reaches a certain level, actuator 76 begins to shift spool 70 to the left in FIG. 2. This pressure difference in apparatus 26 is about 1750 psi. With movement of spool 70 to the left a slight distance, the flow conditions through spool portions 68, 70 change. In particular, and considering spool portion 70, flow takes place between conduits 110, 112 as indicated by the arrow on the right side of spool portion 70 in FIG. 2. Simultaneously, the fluid connection which previously existed through spool portion 68 between conduits 114, 116 is broken. As a consequence, pressure fluid, at the same pressure as that in conduit 40, is now applied to the working surface side of actuator 74. Actuator 74, now in cooperation with actuator 76, causes rapid movement of spool 66 to the left in FIG. 2, whereupon flow through this spool portion changes from that indicated within the left square in the portion to that indicated within the right square in the portion.

It will be noted that this shifting of spool portion 66 produces a parallel connection between motors 22, 24, whereupon pressure fluid tends to flow simultaneously into the rod ends of the cylinders from conduit 40, and to exhaust simultaneously from the butt ends of the cylinders to conduit 42.

As will become apparent shortly with such shifting of spool 66, the pressure difference between fluid in conduit 40 and that in conduit 42 drops significantly. It is important that this pressure difference drop not effect a return of spool 65 to the position shown for it in FIG. 2. This concern, plus the fact that it is desirable to effect a relatively rapid shifting of the spool substantially precisely when the pressure difference mentioned earlier reaches the level indicated, is the reason why the working surface areas of actuators 74, 76 are different. More specifically, initially only the working surface area of actuator 76, the smaller of the two areas, is exposed to pressure fluid within conduit 40. Because of the relatively small size of this area, a significant pressure must be reached within conduit 40 relative to conduit 42 before the actuator can shift spool portion 70 far enough to communicate this pressure fluid to the working surface side of actuator 74. However, when such pressure fluid is applied to actuator 74, the considerably larger area of the working surface of this actuator, in conjunction with the smaller area on actuator 76, produces a greatly increased shifting force on spool portion 66, causing this spool portion to shift rapidly to the left in FIG. 2. Also, the combined working surface areas of actuators 74, 76 now permit a considerable drop in the pressure of fluid in conduit 40 before biasing mechanism 78 is able to return the spool to the position in which it is shown in FIG. 2. While different specific lower pressure differences may be selected for allowing return of the spool, a specific pressure difference which has been selected herein for apparatus 26 is about 150 psi.

Considering further the impeded-arm situation now being discussed, with motors 22, 24 in parallel, let us assume that the first one of the two clamping arms to engage the side of a load is arm 18. If this is the case, movement of arm 18 stops, with pressure fluid continuing to be supplied to the rod end of cylinder 34, at the same flow rate, thus continuing movement of arm 20 toward the load at the same speed which it initially had. If the reverse situation were true, namely, that it is arm 20 which first engages the side of a load, movement of this arm stops, with pressure fluid continuing to be supplied to the rod end of cylinder 28. Because the working surface area on the rod end side of piston 30 is larger than that on the rod end side of piston 36, arm 18 continues moving toward the load, but at a somewhat slower rate.

When both arms have engaged the load, a clamping force is built up between the arms, with extremely slow high-power relative movement between the arms — arm 18 tending to move toward arm 20, with the latter tending to remain stationary. The reason for this, of course, is that in the parallel-connected condition of motors 22, 24, the rod end side of piston 30 presents a greater working surface area than the rod end side of piston 36. Valves 60, 64, of course, prevent the escape of fluid from the rod end side of cylinder 34. When a sufficiently great clamping force has been built up, the supply of pressure fluid through conduit 40 is cut off, with valve 62 then preventing the escape of fluid from the rod end of cylinder 28. Thus, the load is now clamped between the arms.

To release the load, pressure fluid is supplied from the main supply on the truck to conduit 42, and is exhausted from conduit 40. As pressure fluid is supplied through conduit 42, the shuttle in shuttle valve 56 shifts to the position shown for it in FIG. 2, and actuator 72, in cooperation with mechanism 78, shifts spool 65 to the position shown for it in FIG. 2. Pilot-operated check valves 62, 64 are piloted open, thereby allowing fluid to escape from the rod ends of cylinders 28, 34.

It will be noted that once again motors 22, 24, are connected effectively in series. Fluid supplied through conduit 42 flows through conduit 48 to the butt end of cylinder 28. Fluid exhausting from the rod end of this cylinder flows to the butt end of cylinder 34, with fluid then exhausting from the rod end of cylinder 34 back toward conduit 42. Because the pressure of fluid in conduit 42 is at this time less than that of fluid exhausting from the rod end of cylinder 34, the fluid which exhausts from cylinder 34 becomes a regenerative flow, adding to that which is entering through conduit 42, to speed the opening of the arms. In other words, arm opening under these circumstances occurs at a considerably higher speed than initial arm closing toward a load. This increased speed during opening of the arms, of course, increases the time and energy efficiency of apparatus 26.

Should either arm, during opening, strike some external object, its movement stops, and the other arm continues opening. For example, if opening of arm 18 is hindered, valve 58 opens to bypass fluid past motor 22. Similarly, if outward movement of arm 20 stops, valve 60 opens to bypass motor 24.

It will thus be apparent how the unique features of valve 44 enable precise and efficient control of the functioning of motors 22, 24. Sensed pressure differences accurately effect the position of spool 65.

It will be obvious that valve 44 need not be incorporated with other valves.

Thus, while a preferred embodiment of the invention has been described herein, it should be apparent to those skilled in the art that variations and modifications are possible without departing from the spirit and scope of the present invention defined in the appended claims.

What is claimed and desired to secure by Letters Patent is:

1. A control valve for operating in response to the pressure difference between a pair of fluid communication ports in the valve comprising a valve body, a valve spool mounted within said body for shifting between a pair of control positions, said spool including first and second working surface areas on opposite sides thereof on which pressure fluid may act to shift the spool toward its said two control positions, biasing means acting on said spool yieldably urging the same toward one of its said control positions, means defining a pair of fluid passages in said body, one for communicating between one of said ports and said first working surface area, and the other for communicating between the other port and said second working surface area, means interposed between said one fluid passage and said first working surface area constructed to enable exposure to pressure fluid within said one fluid passage of only a portion of said first working surface area with said spool in its said one control position, and constructed further to enable exposure of the full extent of said first working surface area to such pressure fluid with said spool shifted toward its said other control position, and changeable-condition pressure-balancing means for said spool including means defining an openable-closable fluid path which, with said spool in its said one control position, allows fluid communication between said second working surface area and a portion of said first working surface area which is different from said first-mentioned portion, and which blocks such communication with said spool shifted toward its said other control position.

2. The valve of claim 1, wherein said pressure-balancing means comprises a fluid passage formed within said spool, and a space formed within said valve body outside of said spool, which fluid passage and space move relative to one another with shifting of the spool, said space, with said spool in its said one control position, communicating both with said fluid passage within said spool and said different portion of said first working surface area, said space and said fluid passage being constructed whereby with shifting of said spool toward its said other control position, the two cease to be in communication with one another.

3. A fluid control valve comprising a valve body, a pair of fluid-communication ports in said body adapted for connection to an external source of pressure fluid, an elongated, double-open-ended, tubular-walled valve sleeve mounted within said body and including, adjacent one end thereof, a cut-away portion on the inner side of the wall in the sleeve, means defining a pair of fluid passages in said body, one for communicating between one of said ports and said one end of said sleeve, and the other for communicating between the other port and the other end of the sleeve, means fitted within said one end of said sleeve spanning the cross-sectional area of the hollow interior of the sleeve and including an elongated through-bore permitting fluid communication between said interior and said one fluid passage, a valve spool slidably mounted within said hollow interior of said sleeve for shifting between a pair of control positions therein, said spool including first and second working surface areas on opposite sides thereof on which pressure fluid may act to shift the spool toward its said two control positions, said first working surface area facing said one end of said sleeve and said second working surface area facing said other end of said sleeve, a portion of said first working surface area taking the form of an axial projection from said spool which is axially aligned with the end of said through-bore which is exposed to the hollow interior of said sleeve, said projection, with said spool in one of its said control positions, sealingly closing said end of said through-bore and holding that portion of said first working surface area which is disposed outwardly of the through-bore in an exposed condition within said hollow interior of said sleeve, biasing means acting on said spool yieldably urging the same toward its said one control position, and means defining a fluid passage within said spool which, with the spool in its said one control position, is disposed to allow communication, through said cut-away portion, between said opposite sides of said spool, whereby fluid acting on said second working surface area also acts simultaneously on said second-mentioned portion of said first working surface area, and which further, with the spool shifted toward its other control position, shifts away from said cut-away portion so as to block such communication, shifting of the spool toward its said other control position producing unblocking of said through-bore by said projection, and exposure of the full extent of said first working surface area to fluid within said through-bore.

4. The valve of claim 3, wherein said means which is fitted within said one end of said sleeve comprises a piston slidably received therein which piston is permitted a limited amount of axial reciprocation relative to the sleeve.

5. The valve of claim 3, wherein said fluid passage within said spool includes an elongated axially extending portion which joins with a radially extending portion disposed adjacent said first working surface area.

6. In a control valve for operating in response to the pressure difference between a pair of fluid communication ports in the valve, where the valve includes a valve body, a valve spool mounted within said body for shifting between a pair of control positions, with said spool including first and second working surface areas on opposite sides thereof on which pressure fluid may act to shift the spool toward its said two control positions, biasing means acting on said spool yieldably urging the same toward one of its said control positions, and means defining a pair of fluid passages in said body, one for communicating between one of said ports and said first working surface area, and the other for communicating between the other port and said second working surface area, the improvement comprising:

means interposed between said one fluid passage and said first working surface area constructed to enable exposure to pressure fluid within said one fluid passage of only a portion of said first working surface area with said spool in its said one control position, and constructed further to enable exposure of the full extent of said first working surface area to such pressure fluid with said spool shifted toward its said other control position; and changeable-condition pressure-balancing means for said spool including means defining an openable-closeable fluid path which, with said spool in its said one control position, allows fluid communication between said second working surface area and a portion of said first working surface area which is different from said first-mentioned portion, and which blocks such communication with said spool shifted toward its said other control position.

7. In a fluid control valve, including a valve body, and a pair of fluid-communication ports in said body adapted for connection to an external source of pressure fluid, the improvement comprising an elongated, double-open-ended, tubular-walled valve sleeve mounted within said body and including, adjacent one end thereof, a cut-away portion on the inner side of the wall in the sleeve, means defining a pair of fluid passages in said body, one for communicating between one of said ports and said one end of said sleeve, and the other for communicating between the other port and the other end of the sleeve, means fitted within said one end of said sleeve spanning the cross-sectional area of the hollow interior of the sleeve and including an elongated through-bore permitting fluid communication between said interior and said one fluid passage, a valve spool slidably mounted within said hollow interior of said sleeve for shifting between a pair of control positions therein, said spool including first and second working surface areas on opposite sides thereof on which pressure fluid may act to shift the spool toward its said two control positions, said first working surface area facing said one end of said sleeve and said second working surface area facing said other end of said sleeve, a portion of said first working surface area taking the form of an axial projection from said spool which is axially aligned with the end of said through-bore which is exposed to the hollow interior of said sleeve, said projection, with said spool in one of its said control positions, sealingly closing said end of said through-bore and holding that portion of said first working surface area which is disposed outwardly of the through-bore in an exposed condition within said hollow interior of said sleeve, biasing means acting on said spool yieldably urging the same toward its said one control position, and means defining a fluid passage within said spool which, with the spool in its said one control position, is disposed to allow communication, through said cut-away portion, between said opposite sides of said spool, whereby fluid acting on said second working surface area also acts simultaneously on said second-mentioned portion of said first working surface area, and which further, with the spool shifted toward its other control position, shifts away from said cut-away portion so as to block such communication, shifting of the spool toward its said other control position producing unblocking of said through-bore by said projection, and exposure of the full extent of said first working surface area to fluid within said through-bore.

* * * * *